US007540789B2

(12) United States Patent
Gerber et al.

(10) Patent No.: US 7,540,789 B2
(45) **Date of Patent: *Jun. 2, 2009**

(54) PLUG-AND-SOCKET CONNECTOR FOR DATA TRANSMISSION VIA ELECTRICAL CONDUCTORS

(75) Inventors: Matthias Gerber, Ruti (CH); Rolf Weber, Freienstein (CH); Patrick Zollinger, Fallanden (CH)

(73) Assignee: Phoenix Contact GmbH & Co. KG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/828,662

(22) Filed: Jul. 26, 2007

(65) Prior Publication Data

US 2008/0057793 A1 Mar. 6, 2008

Related U.S. Application Data

(62) Division of application No. 11/354,309, filed on Feb. 14, 2006, now Pat. No. 7,249,979.

(30) Foreign Application Priority Data

Feb. 17, 2005 (EP) ..... 05405196

(51) Int. Cl.
*H01R 24/00* (2006.01)

(52) U.S. Cl. ..... 439/676; 439/941

(58) Field of Classification Search ..... 439/344, 439/676, 76.1, 941

See application file for complete search history.

(56) References Cited

U.S. PATENT DOCUMENTS

| | | | |
|---|---|---|---|
| 5,403,200 | A | 4/1995 | Chen |
| 5,547,405 | A | 8/1996 | Pinney et al. |
| 6,083,014 | A | 7/2000 | Bogdan et al. |
| 6,102,730 | A | 8/2000 | Kjeldahl et al. |
| 6,338,655 | B1 | 1/2002 | Masse et al. |
| 6,398,591 | B1 | 6/2002 | Hess et al. |
| 6,419,527 | B2 | 7/2002 | Reichle |
| 6,752,647 | B1 | 6/2004 | Lin |
| 6,786,775 | B1 | 9/2004 | Hanrahan et al. |
| 7,175,476 | B2 | 2/2007 | Kim et al. |
| 7,179,115 | B2 | 2/2007 | Hashim |

(Continued)

FOREIGN PATENT DOCUMENTS

| | | |
|---|---|---|
| DE | 298 04 836 U1 | 3/1998 |

(Continued)

*Primary Examiner*—Khiem Nguyen
(74) *Attorney, Agent, or Firm*—DeMont & Breyer, LLC

(57) ABSTRACT

The invention specifically relates to a plug-and-socket connection part (1) of a plug-and-socket connection for a data transmission cable with a plurality of electrical conductors, comprising a connection housing, and per electrical conductor, a connection contact element (31) held by the connection housing, in each case with one insulation displacement contact (31.1) or a piercing contact, for contacting the electrical conductor, as well as in each case a contact (13.1) for contacting corresponding contacts of a corresponding counter piece with the plug-and-socket connection part. Each insulation displacement contact (31.1) or each piercing contact is electrically connectable to one of the contacts. The invention is characterized essentially in that the connection housing is shaped, such that the connection contact elements (31) may not be introduced from the outside into the connection housing.

1 Claim, 8 Drawing Sheets

U.S. PATENT DOCUMENTS

| | | | | |
|---|---|---|---|---|
| 7,186,149 | B2 | 3/2007 | Hashim | |
| 7,249,979 | B2 * | 7/2007 | Gerber et al. | 439/676 |

FOREIGN PATENT DOCUMENTS

| | | | |
|---|---|---|---|
| DE | 100 55 148 | C2 | 5/2002 |
| DE | 102 58 725 | A1 | 6/2004 |
| EP | 0 590 667 | A1 | 4/1994 |
| EP | 0 67 1780 | B1 | 9/1995 |
| EP | 0 899 827 | A2 | 3/1999 |
| EP | 0 944 137 | A2 | 9/1999 |
| EP | 0 991 149 | A2 | 4/2000 |
| EP | 1 128 494 | A2 | 8/2001 |
| WO | 96/42125 | | 12/1996 |
| WO | 97/44862 | | 11/1997 |
| WO | 03/012932 | A1 | 2/2003 |

* cited by examiner

PLUG-AND-SOCKET CONNECTOR FOR DATA TRANSMISSION VIA ELECTRICAL CONDUCTORS

This application is a divisional of application Ser. No. 11/354,309, filed Feb. 14, 2006, now U.S. Pat. No. 7,249,979 which claims priority to European Patent Application EP 05405196.6, filed Feb. 17, 2005.

BACKGROUND OF THE INVENTION

The present invention relates to a plug-and-socket connector for data transmission cables with a plurality of electrical conductors which, for example, are twisted in pairs. The invention in particular relates to a plug-and-socket connector according to an international standard, for example the standard IEC 60603-7 (called RJ45 for short) or IEC 61076-2-xx (round plug-and-socket connector for the low voltage range, represented here by: M12).

Data transmission systems with a plurality of electrical conductors, in particular of the type with conductors twisted in pairs, are assuming greater and greater significance. It is particularly in the field of the office that the structured building-wiring has had much success. This, amongst other things, is due to standardized plug-and-socket connections.

The increasing digitalization in all fields of everyday life leads to the fact that plug-and-socket connections, also originally designed for the telecommunications- and office field, for example of the type RJ45, are increasingly also used in other fields of application. The great success which structured building-wiring has in the field of the office should also be exploited in other fields of application. Therefore, the field of industry, of building automation and the audio field are to be specifically mentioned.

These new fields of application entail new demands on the product. Two new demands on an RJ45 plug in these fields are, for example, the wiring ability on location without special tools, or the use with different, more robust cables (conductor diameter, construction, size etc.) than are usual in the office field. These plugs, however, should simultaneously also be very compact, so that they remain compatible with existing end apparatus.

In order to be able to ensure a sufficient wiring comfort and a broad field of application, known and commonly used cut-and-clamp technology is particularly suitable for the connection technology. With this connection technology, insulation displacement connectors or insulation displacement contacts (IDCs) are used. Connection blocks with IDCs have been known for some time, for example from EP 0 671 780. These known IDC blocks, however, do not fulfill the demands with regard to the compactness.

Of the existing RJ45 plug-and-socket systems, connection techniques are known which comprise IDCs in the direction of the longitudinal axis of the plug. With these plug-and-socket systems, the connection conductors are introduced into the IDCs by way of a movement in the axial direction, i.e. in the insert direction of the RJ45 plug. Usually, a wiring piece is applied at the same time in which the conductors are previously laid, and which for contacting, is moved relative to the plug housing in the axial direction. Such a wiring piece usually has a central hole through which the cable is led. Thereafter, the conductors are held in the wiring piece, bent at an angle radially to the cable direction, and are presented with the IDCs for contacting (for this, see e.g. EP 0 899 827, DE 102 58 725, U.S. Pat. No. 6,752,647). These connection techniques, although having the potential to fulfill the requirements with regard to size are, however, not suitable with regard to handling ability and stability for covering the total cable cross-sectional range required in the new fields of application.

For this reason, it would be desirable to have a plug-and-socket connection part at one's disposal, which similar to the original IDCs, is radially wired, but which may be designed in a more space-saving manner by way of wiring on both sides. Such a solution with a single-piece wiring block is known from EP 991 149. The disadvantage with such a single-piece wiring block is the fact that the required individual conductor mountings in the IDC chambers must be broken or weakened, so that the IDCs on manufacture of the connection block may be applied at all into chambers envisaged for this. The consequence of this is that either a clean individual conductor strain relief is no longer guaranteed, or that for an adequately large wall thickness, the distances between the individual conductors (also called cable cores or stranded wire conductors or wires) must be selected so large that the connection block no longer meets the initially posed demands with regard to the dimensioning.

BRIEF SUMMARY OF THE INVENTION

It is the object of the invention to provide a plug-and-socket connection part (generally a plug or a socket) for an electrical data transmission cable, which is based for example on cut-and-clamp technology and overcomes disadvantages of plug-and-socket connection parts according to the state of the art. The plug-and-socket connection part in particular should be suitable for plug-and-socket connections of the standard RJ45 and preferably also M12, as well as further standards, as the case may be, permit use with different, more robust cables than is usual in the field of the office (conductor diameter etc.) and/or provide the ability to wire on location without special tools, and/or be very compact so that they remain compatible with existing end apparatus.

Specifically, the invention relates to a plug-and-socket connection part for a data transmission cable with a plurality of electrical conductors, comprising a connection housing, and per electrical conductor, a connection contact element held by the connection housing, in each case with an insulation displacement contact or a piercing contact, for contacting the electrical conductor, as well as in each case a contact for contacting corresponding contacts of a corresponding counter piece with the plug-and-socket connection part. Each insulation displacement contact or each piercing contact is electrically connectable to one of the contacts. The invention is characterized in that the connection housing is shaped such that the connection contact elements may not be introduced into the connection housing from the outside, whereas generally with the wiring, the conductors are led to the housing from the outside.

Since no introduction of contact elements from the outside needs to be provided, it is not necessary to weaken the individual conductor mounting in order to create space for the introduction of the insulation displacement contacts from the outside. A mechanically stable individual conductor mounting may be made without taking up too much space. The connection housing may for example comprise a transverse rib, which runs in the radial direction outside the connection contact elements, and longitudinal ribs between which the insulated conductors are introduced in a mechanically stabilized manner on contacting. The chambers for the e.g. applied insulation displacement contacts may be shaped according to requirements.

Furthermore, insulation displacement contacts with a relatively large cutting width may be used. A given connection block for conductors of different diameters may be used by way of this.

According to a first preferred embodiment, the connection block comprising the insulation displacement contacts or the piercing contacts is at least of two parts. Both parts comprise several connection contact elements in each case with one insulation displacement contact. The two-part design permits the connection contact elements to run in sections between the housing parts, and to be able to be introduced into the connection housing parts from an inner side, on manufacture of the plug-and-socket connection part.

An electrically insulating separating film may be arranged between the mentioned housing connection parts, and may run along a (middle) plane and electrically insulate the connection contact elements of the two parts of the connection block from one another. The mentioned flat sections which are coupled in pairs may be electrically insulated from one another by way of the separating film. This permits the intensity of the capacitative coupling to be predefined by way of the selection of the material and the thickness of the separating film.

Instead of a separating film, the connection block may also comprise distancers which are shaped on the housing parts and which prevent an electrical contact between connection contact elements in the first and the second housing part.

The two housing parts may, but need not be shaped in an essentially identical manner. An identical shaping may be advantageous with regard to manufacturing technology.

According to one alternative embodiment, the connection housing is one piece. The manufacture is effected in that the connection contact elements are positioned, for example, by way of a tool which is especially provided for this, and subsequently is peripherally injection molded with plastic, so that the housing arises.

The procedure according to the invention permits a targeted NEXT (near end crosstalk) compensation between (connection) contact elements which are carried by the first housing part, and (connection) contact elements carried by the second housing part. This may be effected by way of compensation surfaces for example, which are shaped on the (connection) contact elements, run parallel to one another, and at least partly overlap, so that they are capacitatively coupled.

The insulation displacement contacts of the first and the second part of the connection block are open to different—preferably opposite—directions ("the one insulation displacement contacts face "upwards", the other "downwards"). These opening directions are not axial (with regard to the plug axis), i.e. they form an angle to the axis of the plug-and-socket connection part (or of the cable). The opening directions are preferably perpendicular to the axis of the plug-and-socket connection. Then, a two-sided, radial wiring becomes possible. An analogous construction with radial wiring is also possible in the case of piercing contacts, i.e. the piercing tips project in different—preferably opposite—non-axial directions. In the case of the previously mentioned NEXT—compensation, preferably connection contact elements with different—thus for example opposing—insulation displacement contact opening directions are coupled.

The wiring may be effected with the help of one or two wiring covers. With a first embodiment of the wiring cover, the plug-and-socket connection part (or its connection block) is provided with longitudinal ribs, between which the conductors may be applied. With the wiring cover, the conductors applied between the longitudinal ribs may be introduced from the outside to the inside between the cutting surfaces of the respective insulation displacement contact. The wiring covers in the known manner comprise wiring ribs for this purpose. The wiring cover/covers is/are preferably removable in this embodiment. In this embodiment therefore, the plug-and-socket connection part itself has guide means (the longitudinal ribs) for guiding the conductors, and the wiring cover serves for displacing the conductors within the guide means (for pressing into the channels formed between the guide ribs). Alternatively to this, the wiring cover may also comprise the guide means, and guide the conductors on wiring. For this, according to a first embodiment, two wiring covers are provided which comprise guide means (for example guide holes or insert slots, which are interrupted at the location of the insulation displacement contacts or piercing contacts, i.e. open chambers) for the conductors. The wiring covers according to a first variant, for the wiring, may be translatorily displaceable in opposite directions to one another and towards the plug axis. According to a second variant, they are pivotable and for the wiring are pivoted towards the plug axis. According to a second embodiment, a two-part wiring cover is provided, wherein a hinge-like connection is present between the two parts. The two wiring cover parts in each case have an open chamber in the manner of insert slots. The conductors to be wired are first inserted into the insert slots. The wiring cover parts, as the case may be, are subsequently clipped onto the plug-and-socket connection part or connection block, and tilted toward one another.

According to a particularly preferred embodiment, the connection block (comprising the connection housing and the connection contact elements as well as, where appropriate, the separating film) is formed as a component separate to the contact block. The contact block then contains contact elements on which the plug or socket contacts are shaped. The connection block and the contact block may, for example, be connected to one another by way of a plug-and-socket connection. In each case, a connection contact element is electrically connected to a contact element, for example in a direct manner, via contact surfaces formed on the connection contact elements and contact elements, on bringing together the connection block and the contact block.

This embodiment permits the use of the same connection block for the plugs and sockets and/or for different plug standards. Only the contact block needs to be configured differently with the plug/socket or with different plug standards. This embodiment thus entails advantages with regard to the rationality and variability. Furthermore, under certain circumstances one does not need to wire afresh if an already wired plug-and-socket connection part is to be replaced by a plug-and-socket connection part according to a different standard.

The plug-and-socket connection parts according to the invention are, for example, designed according to the RJ45 or M12 standard. The outer dimensions—measured in a plane perpendicular to the axial direction, advantageously do not exceed 13 mm×13 mm. Embodiments with which the connection block or the complete plug-and-socket connection part do not exceed a diagonal dimension of 14.3 mm, i.e. with which the connection block or the whole plug-and-socket connection part fits into a cylindrical tube with an inner diameter of 14.3 mm, are particularly preferred.

According to a preferred embodiment, the plug-and-socket connection part has a coupling element which capacitatively couples selected conductors of a data transmission cable which are led in parallel in sections, in a targeted manner. Sections of twisted pair conductors extending parallel, next to one another, or of contact elements which are allocated to these produce a crosstalk from one pair to the other one. With two pairs which are led next to one another in a plane, one conductor or contact element of the first pair lies directly next to one conductor or contact element of the second pair. An overweight of capacitative coupling exists between these (the inductive coupling also exists, but is not considered here).

The crosstalk arising by way of this coupling may be influenced or compensated by way of different means. Methods with which e.g. a contact element pair is crossed in the half of the parallel direction of extension, or compensation surfaces are integrally formed on individual contact elements which produce an additional targeted crosstalk between suitable contacts are known. These known methods limit the design freedom on configuring the contacts, and render necessary complex (and thus in many cases expensive) shaping of the contacts necessary.

The new method which is described here assumes that the coupling conductors or contact elements, which do not lie directly next to one another is effected with an additional component which is separated from the pair contacts by way of a dielectric [material] (e.g. air or a film). This additional coupling element contains two surfaces which produces the desired coupling (here e.g. at 1*b* and at 2*b*), and a connection part which connects these two coupling surfaces. The connection part has a coupling that is as small as possible to the contact element or the conductor lying therebetween. This may be realized in that the connection part comprises at least one recess, or that the distance to the contact element or conductor lying therebetween is larger than at the coupling surfaces. The coupling element may e.g. be shaped in a hat-like manner, or the contact element lying therebetween or the conductor lying therebetween may be sunk.

The great advantage of this type of compensation is that the pair contacts and the coupling elements may be manufactured separate from one another, and thus remain very simple and inexpensive (e.g. on a plane next to one another). The investment costs for this type of compensation may be kept relatively low on account of the simple tools.

A coupling element of this type, as mentioned, may be used with plug-and-socket connection parts of the previously described type. It may also be used with differently designed plug-and-socket connection parts or also in connection systems, such as, for example, contact elements of terminal strips and distributor strips.

The invention also relates to a connection block for use in a plug-and-socket connection part of the previously described type, as well as to a method for manufacturing a plug-and-socket connection part. Such a method for the embodiment with a two-part connection housing comprises the steps of:

providing two housing parts of a connection housing;

introducing connection contact elements in each case with a insulation displacement contact into the housing parts from the first side, such that an insulation displacement contact opening defined by two cutting parts of each insulation displacement contact projects away from the first side into an insert slot which is formed on a second side of the housing parts which is opposite to the first side;

joining together (for example by welding, bonding or a snap connection) the two housing parts such that their first sides connect to one another and come to lie in an interior of the connection housing, and the two sides form outer sides of the connection housing.

For the embodiment with the peripherally injected connection housing, the method comprises the steps of:

placing connection contact elements (31) in each case with an insulation displacement contact (31.1) or a piercing contact, such that insulation displacement contact openings defined by two cutting parts of each insulation displacement contact, or piercing tips of the piercing contacts, of different contact elements, project in different radial directions;

peripherally injection molding or peripherally casting the connection contact elements such that a connection housing holding the connection contact elements arises.

BRIEF DESCRIPTION OF THE DRAWINGS

Embodiments of the invention are hereinafter described in more detail by way of the drawings. In the drawings there are shown in.

DETAILED DESCRIPTION OF THE INVENTION

Figure 1:
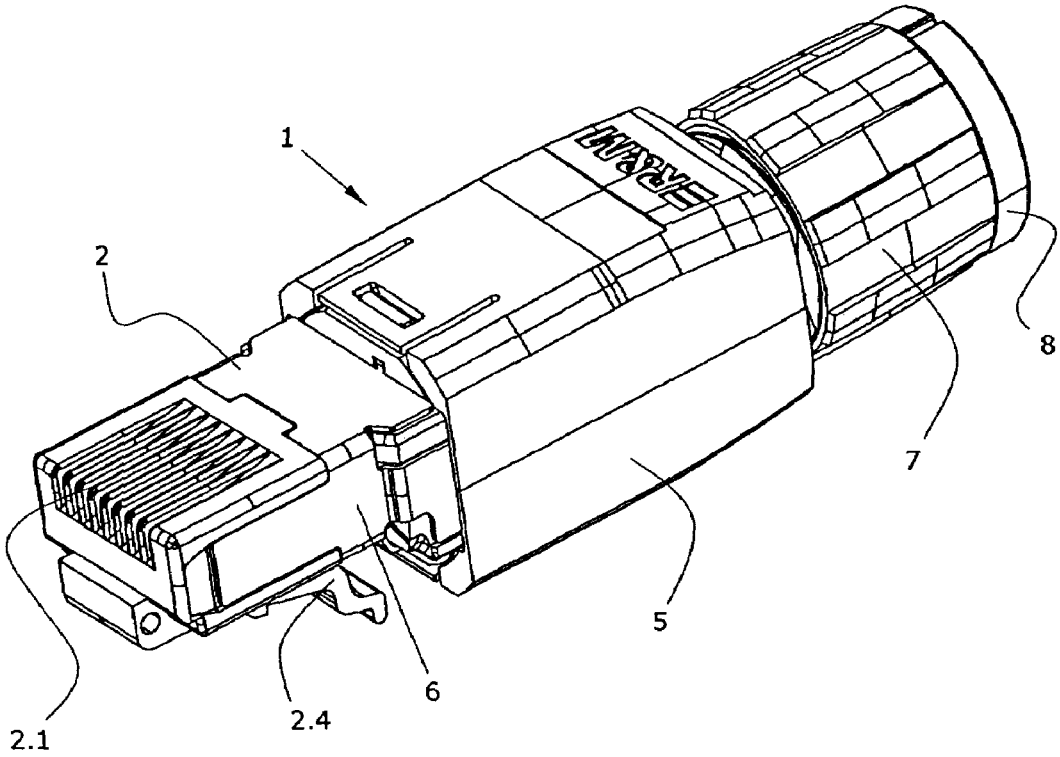
FIG. 1 a representation of a plug according to the RJ45 standard, designed according to the invention.

The same reference numerals in the drawings indicate equal elements.

The plug-and-socket connection part 1 drawn in FIG. 1 is a plug according to the widely distributed RJ45 standard. One recognizes a contact housing, specifically a plug housing 2 with eight channels 2.1 in which plug contacts lay bare. The plug housing in the known manner comprises a jack 2.4 which effects a reversible fastening of the plug in an associated socket (not drawn). A connection block which is not visible in the Figure is covered by an overhousing 5 and a shroud 6. A union nut 7 as well as a coding 8 for a specific color coding are also visible in the FIG. 1.

Figure 2:
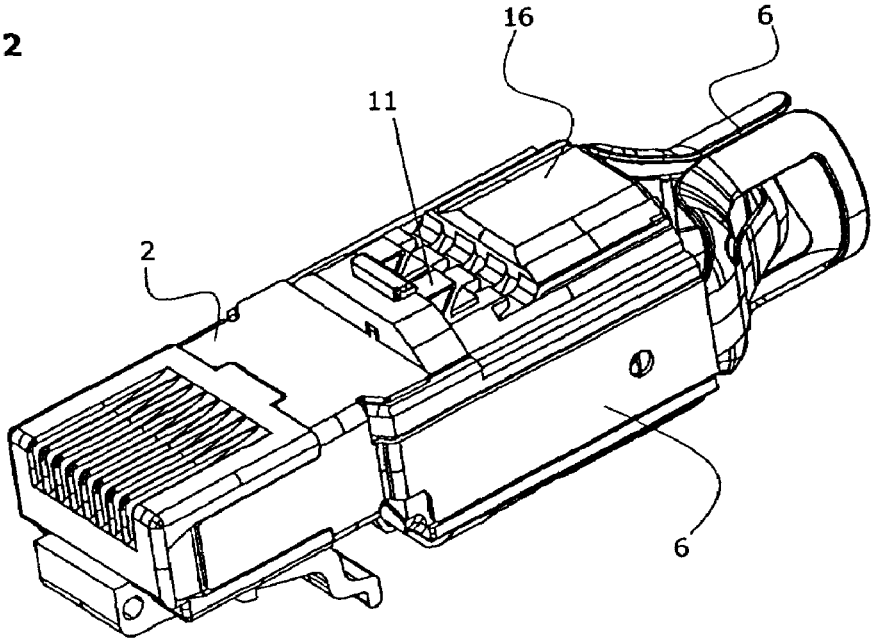
FIG. 2 a representation of a plug according to FIG. 1, without an overhousing and union nut.

FIG. 2 reveals a view of the connection block 11, and shows the shape of the shroud 6 much more clearly, which shields the inside of the plug over the whole length of the plug.

Figure 3:
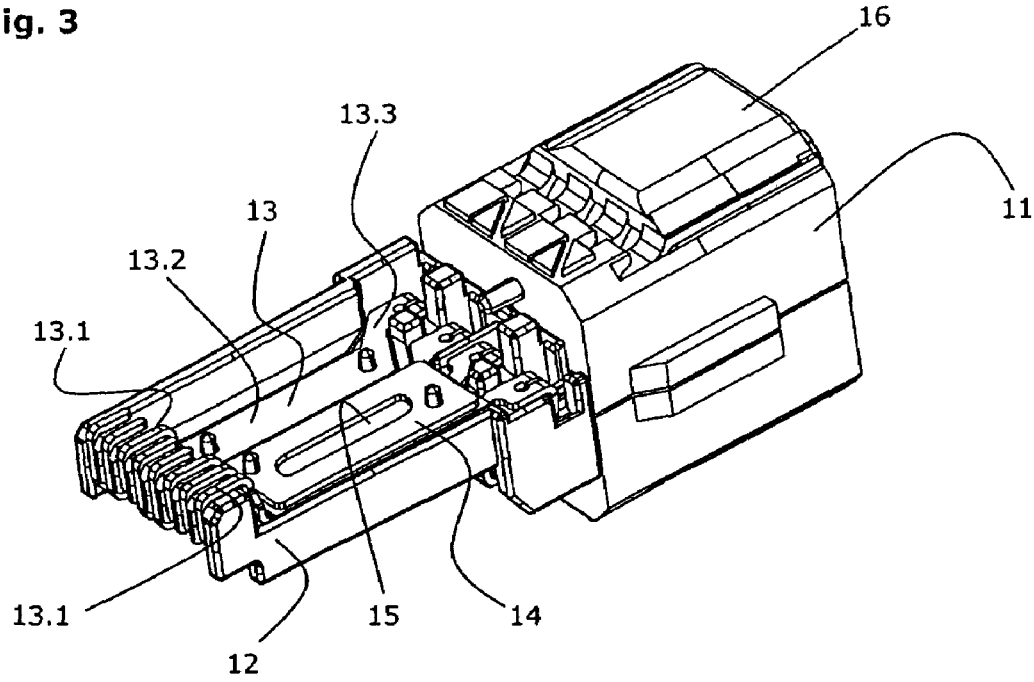
FIG. 3 a representation of the plug according to FIG. 2, wherein here the shroud and the plug housing are not represented.

FIG. 3 shows the contact receiver 12 which is present in the inside of the plug housing and is coupled to the connection block 11 by way of a plug-and-socket connection. The contact receiver holds eight plug contact elements 13 on which the plug contacts 13.1 are shaped. In this text, these contact elements with the plug contacts or socket contacts are simply called "contact elements" 13 in contrast to the "connection contact elements" which are described hereinafter and which comprise the insulation displacement contacts. The contact elements 13, from a rear side facing the connection block, with a fork contact 13.3, lead via a connection section 13.2 to the plug front side with the plug contacts 13.1. Thereby, the connection sections 13.2 of some of the contact elements 13 are guided along the (with respect to the represented orientation) lower side of a base surface of the plug receiver, whilst others run along its upper side. The shape and position of the contact elements, with the exception of the plug contacts 13.1, may be selected differently, depending on the embodiment, and may for example be adapted such that a crosstalk behavior between the contact elements corresponds to a certain setting. The position of the contact elements may be fixed by way of their shape as well as the shaping of the contact receiver.

An electrically conductive coupling element 14 is also drawn in the Figure, and is insulated from the contact elements by an electrically insulating film 15, and influences the crosstalk between cable pairs in a controlled manner. The coupling element and its function are described in an even more detailed manner in the following.

Figure 4:
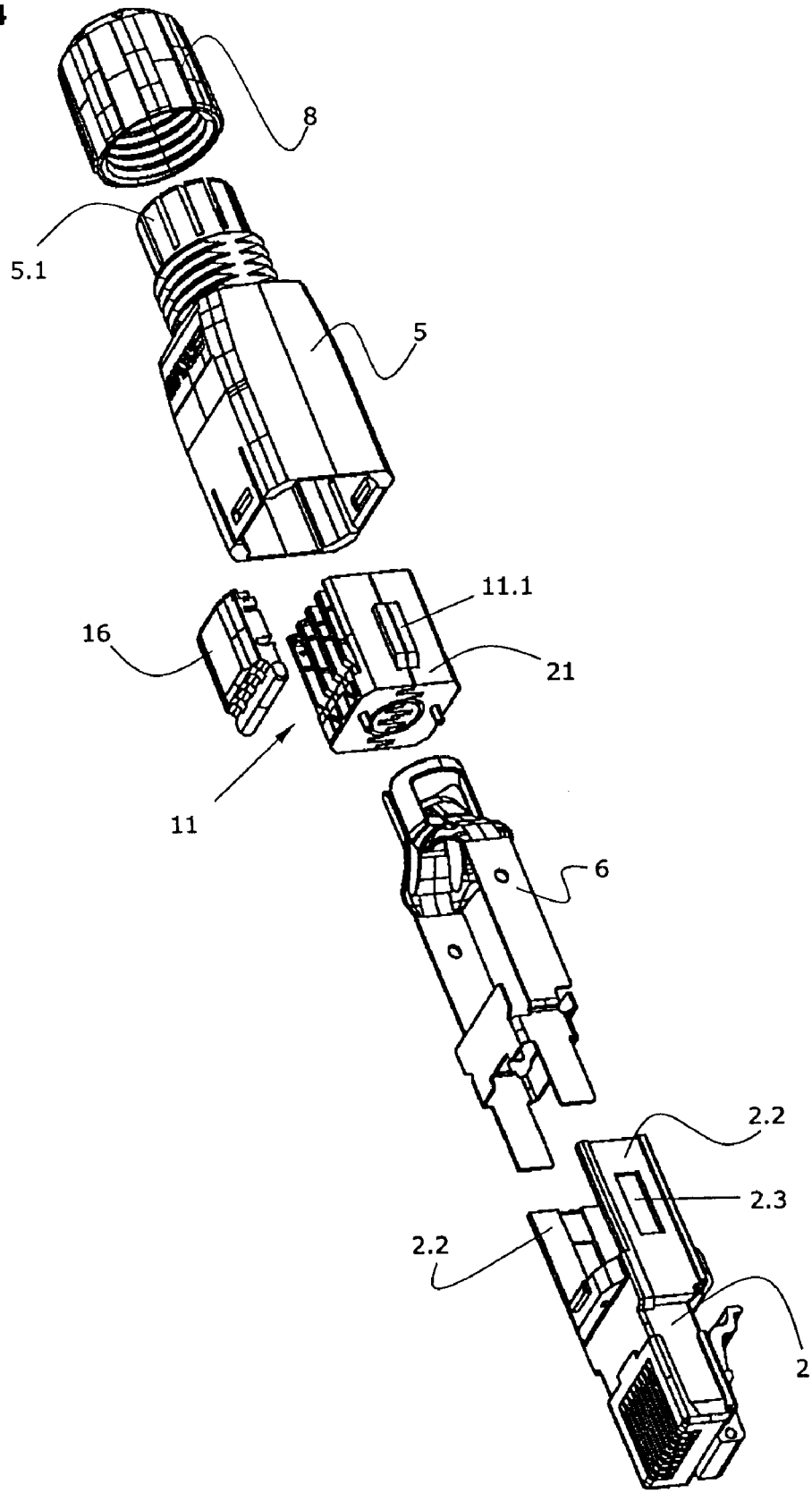
FIG. 4 an exploded representation of the plug according to FIG. 3, but without connection contact elements and contact elements, wherein the contact receiver is introduced into the plug housing and is not visible in the Fig.

In the exploded representation according to FIG. 4, one may recognize the plug housing 2 with an inserted contact receiver (not visible), the shroud 6, the connection housing of the connection block which consists of two housing parts 21, with wiring cover 16, the overhousing 5 and the union nut 8, in each case represented as separate components, without contact elements for the propose of overview. The connection block 11 in addition to the visible wiring cover 16 for example, has a second wiring cover which in the shown arrangement is releasably arranged on the lower side of the connection block. This second wiring cover is optional, i.e. a single wiring cover may also be used for the wiring on the upper and on the lower side. Otherwise, wiring covers of the drawn type are known per se and are not described further here.

The plug is composed of these individual parts in that the connection block 21 and the contact block—thus the plug housing 2 with the inserted contact receiver 12—are led together by way of the wiring cover 16, before or also after the wiring. An electrical contact between the connection contact elements and the contact elements is created by way of this. On assembly, the connection block in the shown embodiments is guided by two wing elements 2.2, and holding elements 11.1 lock into corresponding recesses 2.3 of the wing elements 2.2. The shroud 6 from the front side, thus, from the left side in the Figure, is pushed over the plug housing and the connection block. Finally, the overhousing and the union nut which have already been pushed over the cable before the wiring, are fastened from the rear side. The overhousing has elastic clamping elements 5.1 which, on attachment of the union nut, narrow the passage and clamp the contacted cable and by way of this form the strain relief.

Figure 5:
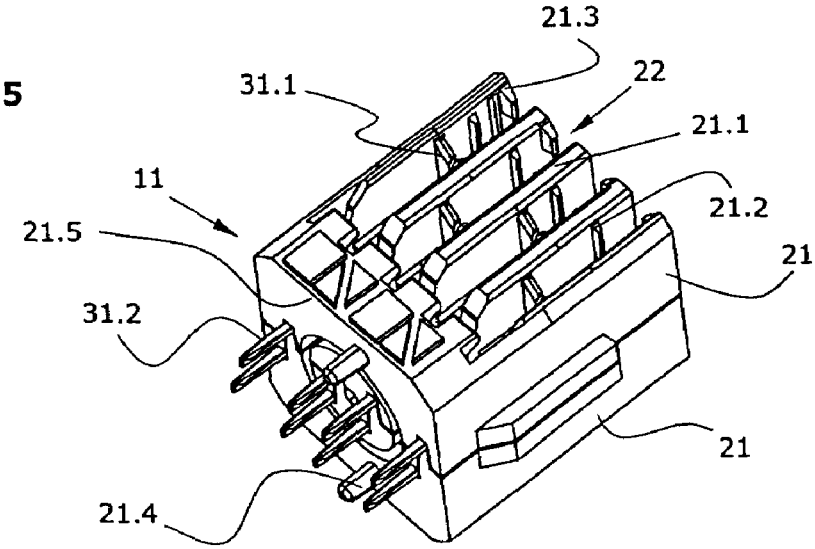
FIG. 5 a representation of the connection block of a plug-and-socket connection part according to the invention.
Figure 9:
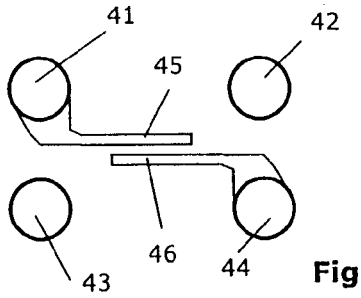
FIG. 9 a schematic sketch which illustrates the function of the compensation surfaces.

The construction and function of the connection block are explained by way of FIGS. 5 and 9.

FIG. 5 shows the connection block without wiring cover. The connection block 11 comprises a connection housing consisting of two housing parts 21. Insert slots 22 for the conductors are formed between intermediate ribs 21.1 of the connection housing which run in the longitudinal direction. From the inside, the insulation displacement contact 31.1 of a connection contact element projects into each of these insert slots 22. In the drawn embodiment, the insulation displacement contacts are offset of one another in the longitudinal direction and are at a 90° angle to the longitudinal direction. However, other embodiments with insulation displacement contacts which are not offset of one another and/or with insulation displacement contacts directed at another angle to the longitudinal direction are also conceivable. Furthermore, the connection housing comprises ribs 21.2 by way of which the conductors (including insulation) may be clamped, and which effect an individual conductor strain relief in that they prevent longitudinal movements and transverse movements of the inserted conductors. Likewise retaining cams 21.3 are visible which project laterally into the insert slots 22, as are known per se from EP 0 671 780. The drawn retaining cams 21.3 serve for the positioning and the preliminary stabilization of the inserted conductors before the wiring (i.e. the pressing-in of the conductors between the insulation displacement contacts). As is likewise known from EP 0 671 780 and in contrast to the drawn embodiment, yet second retaining cams may be present, which are attached towards the middle of the first retaining cams and serve for fixing the conductors after the wiring. These second retaining cams are not required in the drawn embodiment, since the ribs 21.2 also stabilize against radial displacement of the conductors once they have been wired.

The connection contact elements, in each case at the end-face, comprise a contact part 31.2 which projects out of the connection housing and which comprises contact surfaces for contacting the contact elements. In the drawn embodiment, the contact parts 31.2 are pin-like and are designed in order to cooperate with fork-contact-like contact parts of the contact elements. Alternatively to this, they may also act as soldering pins for the connection to a printed circuit. Apart from the contact parts 31.2 of the connection contact elements, two positioning cams 21.4 of the housing parts also project at the end-face. These, on bringing together the connection block and the contact block, cooperate with corresponding recesses in the contact block (for example in the contact receiver) which have not been drawn.

For the drawn embodiment, it is characteristic that the connection housing comprises a transverse rib 21.5 running transversely to an axial direction, which in the radial direction lies outside a section 31.3, 31.4 of the connection contact elements 31. This, in comparison to the state of the art where the insert slots need to be continuous so that the contact elements are capable of being inserted, provides mechanical stability and contributes to rendering a compact construction possible. The transverse rib 21.5 is arranged in the connection block on the plug contact side in the axial direction, whilst the insert slots 22 are open to the cable side.

Figure 6:
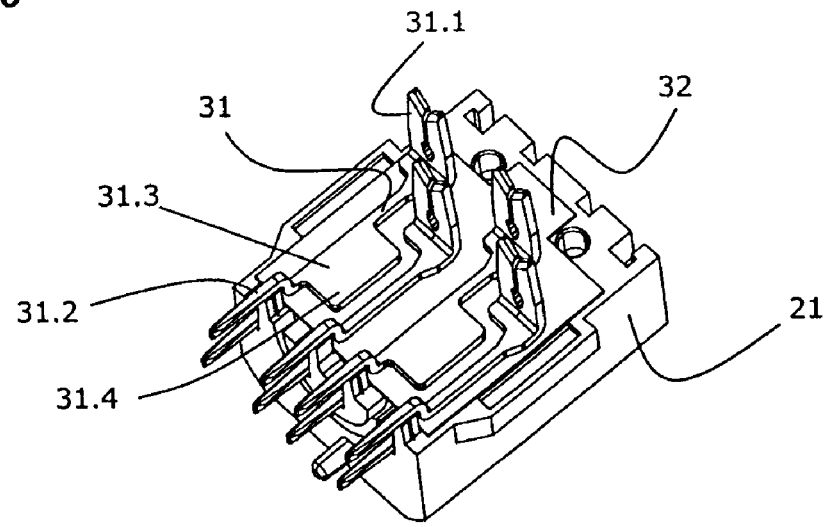
FIG. 6 a representation of the connection block according to FIG. 5 without the upper part of the connection housing.

FIG. 6 shows the connection block according to FIG. 5 without the upper housing part. The connection contact elements 31 between the radially outwardly projecting insulation displacement contacts 31.1 and the contact parts 31.2 comprise an axial (thus along the longitudinal direction) connection section 31.3 which runs between the housing parts. Some of the connection contact elements in the region of the connection section have a compensation surface 31.4, i.e. a flat section running parallel to a (middle) plane. An electrically insulating separating film 32 is located between a first group of connection contact elements 31, with a first insulation displacement contact opening direction (corresponding to the direction in which the cutting parts project; in the Figure to the top), and a second group of connection contact elements 31 with an insulation displacement contact opening direction (to the bottom) which is different. The first group of connection contact elements 31 as well as the separating film 32 are not drawn in FIG. 7. One may see that compensation surfaces 31.4 of connection contact elements 31 of the second group have roughly the same lateral position as corresponding compensation surfaces 31.4 of connection contact elements 31 of the first group. This overlapping of compensation surfaces 31.4 on oppositely lying sides of the separating film 32 may be also clearly seen in FIG. 8.

Figure 7:
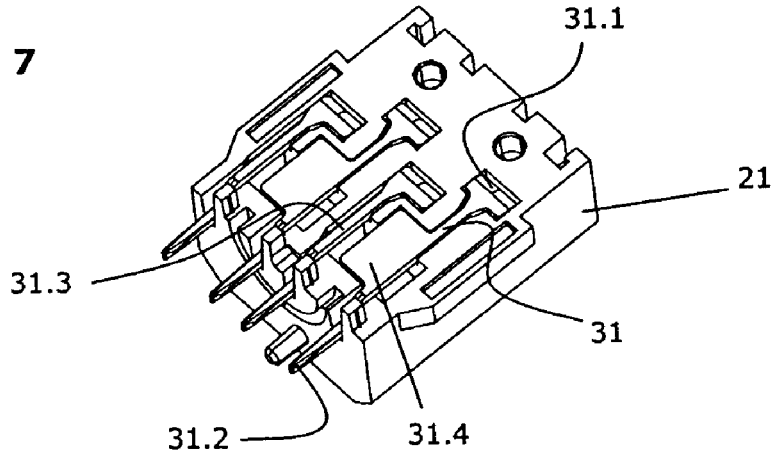
FIG. 7 a representation according to FIG. 6, but without upper connection contact elements and without separating film.

As is particularly well visible in FIG. 7, the housing parts 21 of the connection housing are shaped, such that the connection contact elements 31 may be inserted from the inside, whereas an insertion or removal from the outer side or in the direction of the outer side is not possible. This makes it possible to do away with special provisions (recesses etc.) on the outer side, for the insertion of the connection contact elements. The insert slots 22, the individual conductor strain relief and the shape and position of the insulation displacement contacts may be shaped according to requirements.

On manufacture of the connection block according to the invention, the two housing parts 21 of the connection housing subsequent to the introduction of the connection contact elements 31 and, as the case may be, the placing of the separating film 32, are joined together and are connected in a permanent or reversible manner by way of suitable means. Snap connections, welding, bonding etc. are considered as techniques for joining the housing parts.

Figure 8:
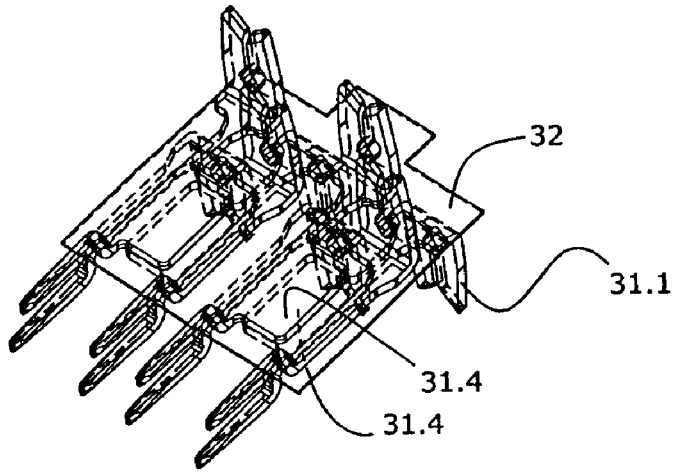
FIG. 8 a representation of the connection contact elements which renders visible the relative positions of compensation surfaces of the upper and lower connection contact elements.

On manufacture of a single-part connection housing in contrast, the connection contact elements and, as the case may be, also the separating film, is fixed in an arrangement as is shown for example in FIG. 8. The fixation may be effected by an injection molding tool which serves for the manufacture of the connection housing with an injection molding method.

The separating film 32, apart from an increase of the capacitative coupling between the compensation surfaces 31.4 of the connection contact elements 31 (depending on the dielectric constant of the separating film material) and an electrical separation, also effects a precise definition of the distance between the connection contact elements of the first and second group. A necessary minimal distancing between the two groups of connection contact elements is significant with regard to the voltage sustaining capability between the connection contact elements. Also at least one distancer may be provided in place of a separating film, and in the simplest case this distancer is integrally formed on the housing parts 21. As a further variant (which however permits no compensation surfaces), the connection sections of the connection contact elements of the first and second group in the same plane may, however, run at different lateral positions.

The function of the compensation surfaces is illustrated in FIG. 9, where four conductors 41, 42, 43, 44 of a data cable are shown schematically. By way of the fact that the conductors are not twisted in pairs but are led in parallel in the wiring region, a capacitative coupling between adjacent conductors 41, 43 and 42, 44, and an inductive coupling between conductor loops 41, 42 and 43, 44 results. This is compensated in that two conductors lying diagonally opposite are capacitatively coupled by way of compensation surfaces 45, 46.

Figure 10:
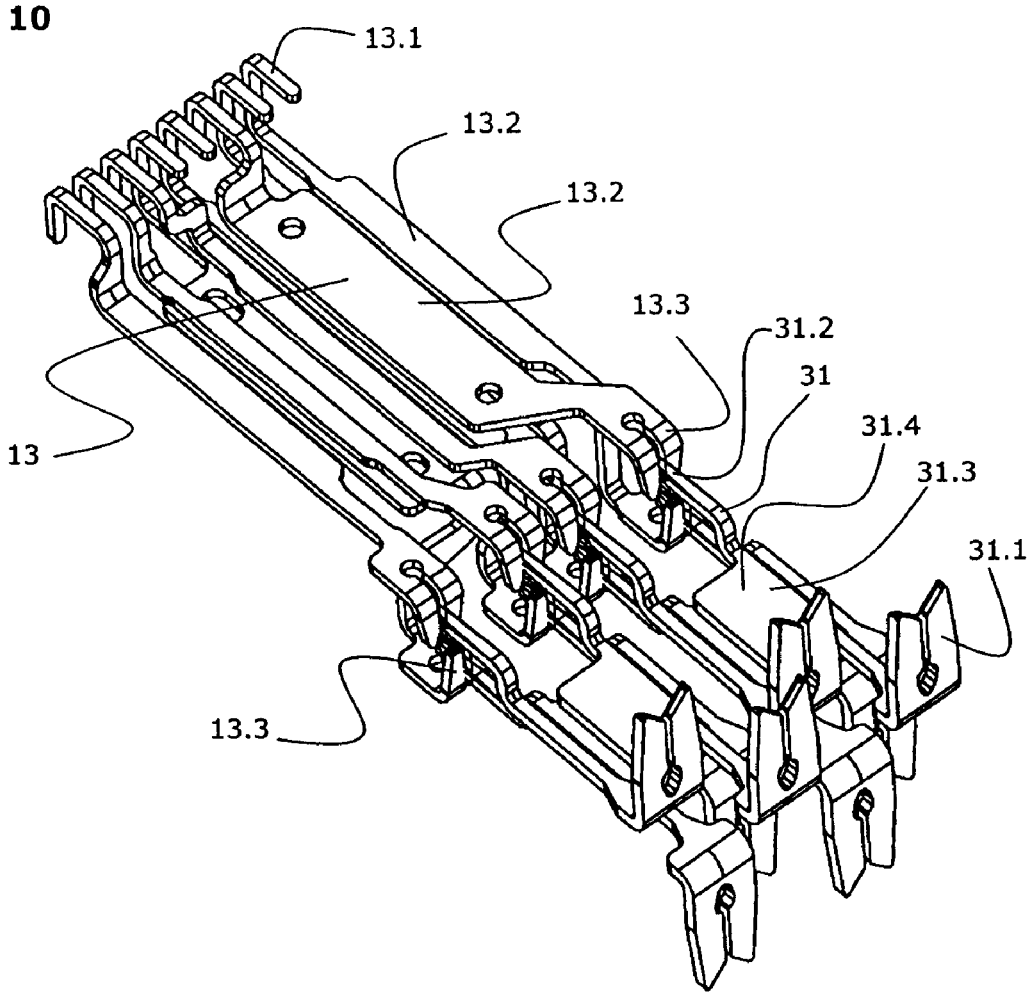
FIG. 10 a representation of the connection contact elements and contact elements.

The shape and relative position of the connection contact elements 31 and contact elements 13 according to one embodiment of the invention is represented in FIG. 10. The drawn position corresponds to the relative position of the connection contact elements and contact elements when the connection block and the contact block are coupled to one another. The contact parts 31.2 of the connection contact elements 31 project into slots of fork contacts 13.3 of the contact elements, by which means an electrical contact arises. In the drawn embodiment, the connection contact elements of the first, upper group are coupled to contact elements whose connection sections 13.2 run on the upper side of the contact receiver base surface (not drawn). Likewise visible is the characteristic wiring, which has the effect that first, second, third and sixth plug contact 13.1 (from the left) are connected to the connection contact elements of the upper group, and the fourth, fifth, seventh and eighth plug contact are connected to the connection contact elements of the lower group.

The function and possible designs of the coupling element are yet described in the following. Coupling elements 14 as drawn in FIG. 3 serve to compensate crosstalk effects between pairs of conductors or contact elements, which extend in parallel next to one another. The coupling elements may, as represented in FIG. 3, be present in the contact housing of a plug-and-socket connection part according to the invention. The coupling elements may, however, also be used in a different plug and socket housing which is not according to the invention, which is available for plug-and-socket connections between data transmission cables of the twisted pair type, and otherwise may be designed according to the state of the art or according to a new, not yet known principle. The coupling elements may also be applied in strips or other parts of data transmission systems, and in particular plug-and-socket connection systems.

Figure 11A:
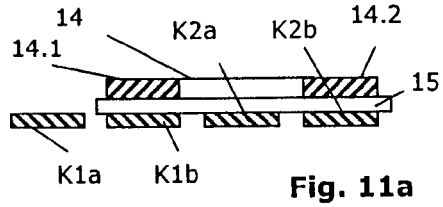
FIGS. 11*a* and 11*b* a sectioned representation of a coupling element and of four contact elements as well as a front view of the coupling element.

As one may particularly recognize in FIG. 11*a*, with two pairs of contact elements K1*a*, K1*b* as well as K2*a*, K2*b* which are arranged in a plane next to one another, two contact elements K1*b*, K2*a* lie much closer to one another than all other contact elements which together do not form a pair. For this reason, an overweight of capacitative coupling exists between these two contact elements K1*b*, K2*a* (the inductive coupling also exists, but is not considered here). The crosstalk which arises by way of this coupling is compensated by the coupling element 14. It acts through a dielectric [material], specifically the insulating film 15.

Figure 11B:
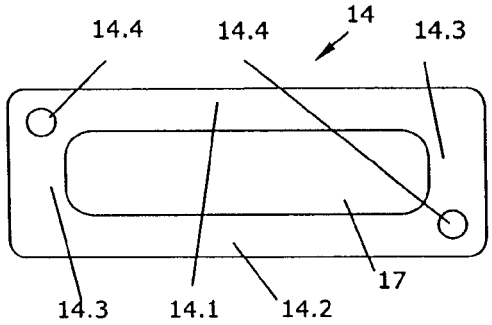

The coupling element 14 may be recognized in FIG. 11*b* in a front view. The coupling element consists of two coupling surfaces 14.1, 14.2 which are coupled capacitatively by way of the dielectric [material] to the contact elements to be coupled. Furthermore, two connection parts 14.3 are present which connect the two coupling surfaces to one another. In the drawn arrangement, the connection parts are present on the coupling element at the end face, i.e. they form the shorter sides of the almost rectangular coupling element.

One may yet see positioning openings 14.4 in FIG. 11*b* which cooperate with corresponding positioning cams (visible in FIG. 3) and in particular fix the lateral position. Of course other positioning means are also possible.

Figure 12:
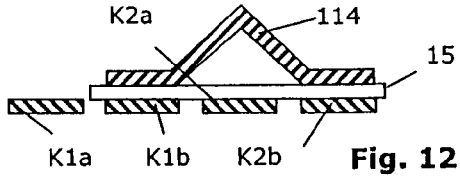
FIG. 12 a sectioned representation of one variant of the coupling element as well as of the four contact elements.
Figure 13:
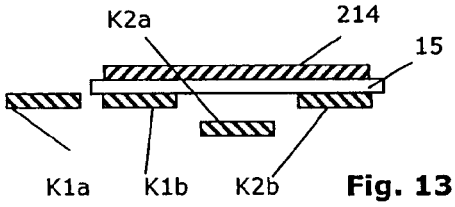
FIG. 13 a sectioned representation of a further variant of an arrangement of a coupling element and of four contact elements.
Figure 14:
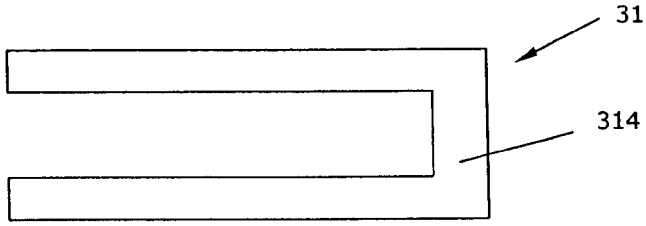
FIG. 14 a view of yet another variant of a coupling element.

Instead of the recess 17 which separates the two coupling surfaces from one another, other means are also conceivable with which one ensures that the coupling relates to the elements to be coupled and not the contact element K2*a* lying therebetween. The coupling element 114 in FIG. 12 is hat-shaped in cross section, so that it has a greater distance to the contact element K2*a* lying therebetween than to the contact elements K1*b*, K2*b* to be coupled. The arrangement according to FIG. 13 envisages the intermediately lying contact element K2*a* being displaced downwards away from the coupling element 214. The coupling element may then be shaped according to FIG. 11*b* or 12, or as drawn, the coupling element may also be simply plate-like without a recess. The coupling element 314 of FIG. 14 finally, functions similarly to that of FIG. 11*a,* but however has only one connection part 314.3.

In one plug-and-socket connection part, as sketched in the FIGS. 11*a*-14, the coupling element may run parallel to the connection section 13.2 of a contact element. The coupling element may however also be designed such that it is led parallel to the conductors, for example, where they run parallel between the wiring ribs.

Further variants of wiring means, in particular of wiring covers for a plug-and-socket connection part according to the invention, are described by way of FIGS. 15-18.

Figure 15:
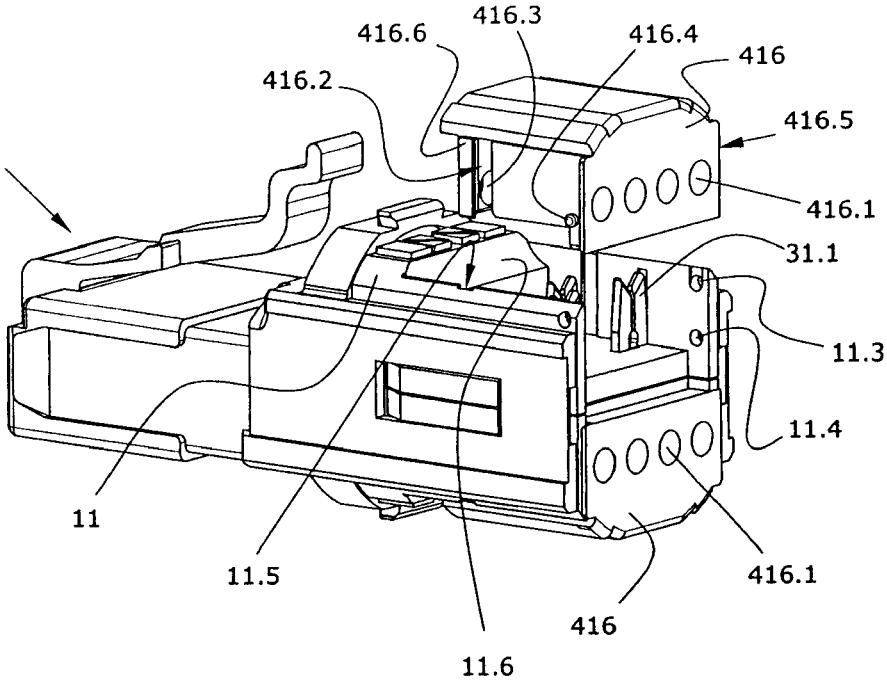
FIG. 15 one embodiment of a plug-and-socket connection part according to the invention, with a wiring mechanism which is an alternative to the above embodiments, FIG. 16 one embodiment with a variant of the wiring mechanism of FIG. 15.

FIG. 15 shows a representation of a plug of the type as is shown in FIGS. 1 to 4, wherein a possible overhousing with a union nut, as well as a shielding lamina are not shown. With the exception of the wiring cover, the components of the plug according to FIG. 15 are analogous to the components of the plug according to FIGS. 1 to 4 and are not described in detail once again. The plug-and-socket connection part 11, specifically the plug, comprises two wiring covers 416, of which one is drawn in the Figure at a distance to the connection block 11 for a better overview. The wiring covers comprise through-holes 416.1. A region 416.2 open to the plug axis connects to these holes in the axial direction towards the insulation displacement contacts 31.1 on the plug side. In the drawn embodiment, guide holes 416.3 follow the open region in the axial direction on the plug side. The wiring covers comprise at least one locking projection 416.4. This may lock into a first locking hole 11.3 or a second locking hole 11.4 of the connection block 11. The wiring covers are shaped such that in the radial direction, and guided by the connection block 11 and possible guide means 416.5, 416.6,11.5 of the wiring cover and/or of the connection block, they are translatorily displaceable relative to the connection block, between a first position and a second position. In the first position, the locking projection 416.4 is locked into the first locking hole 11.3 and in the second position is locked into the second locking hole 11.4.

In contrast to the previously described embodiments, the connection block 11 comprises no insert slots. Rather, in the drawn embodiment, the insulation displacement contacts 31.1, at least partly, project freely to the outside in the radial direction.

For wiring, the shielded cable, for example, is stripped in a first step, and, as the case may be, the shielding braiding is placed back over the outer sheathing of the cable. The individual conductors in the non-stripped condition are subsequently introduced into the through-holes 416.1, and specifically to such an extent that they protrude through the guide-holes 416.3 at the opposite side. With this, the wiring cover is located in its first position. The connection block further comprises a deflection device 11.6 in the form of a deflection surface which under certain circumstances is curved, and which deflects the protruding conductors to the outside, so that they are better accessible to the operator. By way of pulling on the wire conductors or the strand conductors, one may reduce the distance between the outer sheathing and the wiring cover to a necessary minimum. Protruding conductors are subsequently cut off. The wiring cover is then closed by displacing from the first into the second position (in it, the lower wiring cover 416 is drawn in the Figure). Thereby, the insulation displacement contacts project into the open region 416.2. The insulated conductors which are led through the through-holes and guide holes, are introduced between the cutting parts of the insulation displacement contacts 31.1, and at the same time are contacted in the manner known per se.

Figure 16:
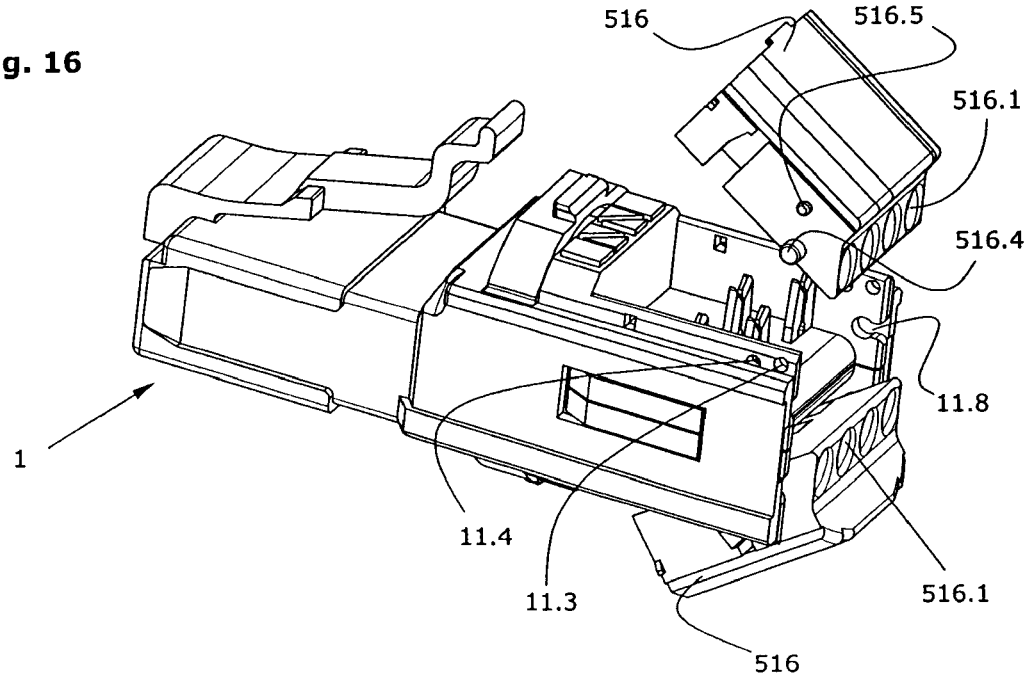

A wiring cover 516 with through-holes 516.1, an open region and guide holes (not visible) is likewise present in FIG. 16. The embodiment according to FIG. 16 differs from that according to FIG. 15, in that the wiring cover 516 is not displaceable between a first position and a second position in a translatory manner, but by way of a pivoting movement. For this purpose, they comprise pivot pins 516.4 which may be locked into a corresponding recess 11.8 of the connection block 11. One locking projection 516.5 is designed to lock the pivot cover in a first or second position by way of locking into a first 11.3 and second locking hole 11.4 respectively. The function of the pivotable wiring cover 516 is otherwise analogous to that of the wiring cover 416 according to FIG. 15. The pivotable wiring cover 516 however has the advantage that the distance between the outer sheathing of the connection cable and the wiring cover may be kept smaller. This is because the radial position of the through-holes 516.1 in the first position of the wiring cover is more favourable (i.e. closer to the plug axis) than in the embodiment according to FIG. 15.

With regard to the embodiment according to FIG. 15, as well as that according to FIG. 16, instead of the drawn and described embodiment, one may also connect open chambers in the manner of insert slots to the through-holes which then, under certain circumstances, are relatively short. These insert slots lead individual conductors (not stripped) in a lateral manner. In this case, the guide holes present on the plug side may also be omitted. The open chambers (insert slots), for example, extend up to the plug-side end of the wiring cover. Holding means may then also be present, which prevent a retraction of the conductors, once introduced, or counteract this. This holding function may be assumed by guide holes in the case that these are present. The guide holes as well as in the other case, the holding means, may comprise elements for this holding function, which project from the outside into the hole or the chamber, and are pivoted out towards the plug side on introducing the conductors. These elements jam and act in the manner of a barb on trying to withdraw the conductors.

Strain-relief means which are not shown, are, for example, connected or connectable to the overhousing, and are possibly separate to the connection block, may be present in the embodiment according to FIG. 15, as well as that according to FIG. 16; and these strain-relief means engage on the cable as a whole, and prevent a tensile force (only) acting on the insulation displacement contacts.

Figure 17:
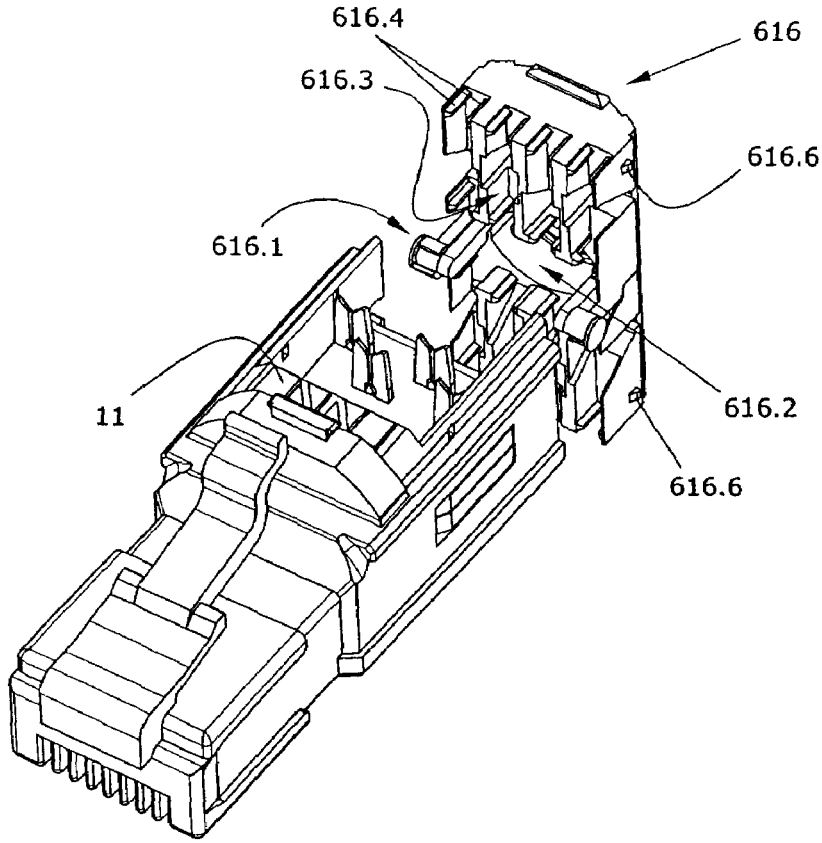
FIGS. 17 and 18 different representations of one embodiment, with a further alternative wiring mechanism.
Figure 18:
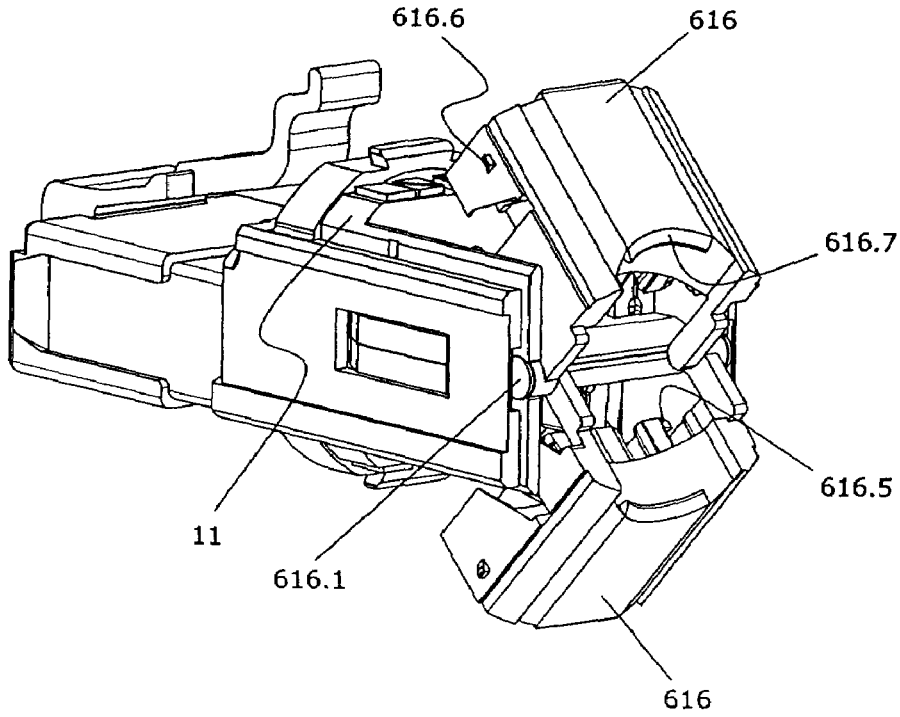

A further variant of a plug-and-socket connection part 1, specifically a plug, is drawn in the FIGS. 17 and 18, with which no individual conductors need to be threaded through the through-holes.

FIG. 17 shows a plug-and-socket connection part, wherein the wiring cover 616 is drawn removed from the remaining plug-and-socket connection part. The orientation of the wiring cover corresponds to that according to the first, open position. In FIG. 18, the wiring cover is drawn in a position between its first and the second, closed position. The wiring cover 616 is of two parts, wherein a hinge-like connection 616.1 is present between the two parts. A cable through-opening 616.2 for the complete cable is formed between the two wiring cover parts. The two parts, in each case, have a plurality of chambers 616.3 in the manner of insert slots, which are open towards one side (corresponding to the plug side, when the wiring cover is in its first position). The insert slots may, in a manner known per se, comprise holding means and/or clamping means 616.4 and/or retaining lugs 616.5, by way of which conductors, once introduced into the chamber, may be held in their position. Locking means 616.6 may be present in this embodiment too, by way of which the wiring cover may be locked relative to the connection block 11 at least in its second position.

The following procedure is to be selected for the assembly. In a first step, the shielded cable, for example, is stripped at the connection side, and the shielding braiding is placed back over the outer sheathing of the cable. The stripped cable is then led through the cable through-opening 616.2, wherein the connection cover is separated, for example, from the remaining plug-and-socket connection part and is held in a half-open position (according to that drawn in FIG. 18). Clamping ribs 616.7 may yet be present peripherally on the cable through-opening 616.2, by way of which the relative position of the cable and wiring cover may be easily fixed for the wiring procedure, after the cable has been brought into the first position drawn in FIG. 17. The individual conductors (not stripped) are then inserted into the open chambers which are provided for this. They are firmly clamped and held in their position by way of the holding- and/or clamping means 616.4 and/or the retaining lugs 616.5, by way of slight pressure. Thereby, they should project out of the pivot cover on the outer side (i.e. the upper and lower one in the Figure). The protruding ends of the conductors are subsequently cut away, and the wiring cover is clipped onto the remaining plug-and-socket connection part, and firmly snapped on the connection block 11 by way of a pivot movement of its two parts. Thereby, the conductors are contacted by the insulation displacement contacts as in the above described embodiments.

Also here, additional strain-relief means may be provided, deviating from the shown embodiment. These may, for example, be present on the overhousing and engage on the cable as a whole. Alternatively or to supplement this, an additional strain relief may also be present, for example by way of an axial positive fit between the wiring cover and the connection block in the closed condition. The possibly present holding- and/or clamping means 616.4 may likewise act in a strain-relieving manner.

The embodiment forms of the FIGS. 15 to 18 may—just as all other embodiments—comprise a connection block and a contact block, as is described and drawn with the previous embodiments. However, this is not necessary with these embodiments, i.e. the plug contact elements and the connection contact elements may be carried by the same housing or may be together with one another as one piece. The two-part design of the connection housing, as with the above embodiments, is also a possible, but not necessary design of the plug-and-socket connection part according to the invention.

The principle of the wiring cover with two parts which may be pivoted towards one another, with a cable through-opening lying therebetween, and with open chambers for inserting the conductors to be wired, may also be used in connection systems other than the plug-and-socket connection system which is described and claimed in this patent application.

The previously described embodiment is only one way of carrying out the invention. Many modifications are conceivable. For example the contact block may be designed according to a plug standard which is different than the RJ45-standard, for example according to the M12-standard which is widespread in industry. The two-part design of the connection block-contact block is not necessary. The connection housing may instead of this also form the plug housing. Separate contact elements are not necessary in this variant, and the (plug) contacts may be formed on the connection contact elements. The drawn shaping of the connection contact elements and contact elements is to be understood merely as examples.

What is claimed is:

1. A connection block for a plug-and-socket connection part, said plug-and-socket connection part being for a plug-and-socket connection for a data transmission cable with a plurality of electrical conductors, the connection block comprising, per electrical conductor of the data transmission cable, a connection contact element present in a connection housing, with in each case an insulation displacement contact or a piercing contact, for contacting the electrical conductor, wherein the connection housing is shaped, such that the connection contact elements may not be introduced into the connection housing from the outside, and wherein the connection housing is composed of at least two housing parts, wherein a first as well as a second housing part of the connection housing carries several connection contact elements with in each case one of the insulation displacement contacts or piercing contacts, and wherein the connection contact elements comprise a section running between the first and the second housing part.

* * * * *

UNITED STATES PATENT AND TRADEMARK OFFICE

CERTIFICATE OF CORRECTION

PATENT NO. : 7,540,789 B2
APPLICATION NO. : 11/828662
DATED : June 2, 2009
INVENTOR(S) : Matthias Gerber et al.

It is certified that error appears in the above-identified patent and that said Letters Patent is hereby corrected as shown below:

Title Page, Item (75)

There are only three Inventors listed:

Matthias Gerber, Ruti (CH); Rolf Weber, Freienstein (CH); Patrick Zollinger, Fallanden (CH)

There should be a total of *six (6) Inventors* listed, with the addition of the following Inventors:

Ralf Geske, Schieder-Schwalenberg (DE); Thomas Beier, Schloss Holte-Stukenbrock (DE); Ralf Lange, Horn-Bad Meinberg (DE)

Signed and Sealed this

Twenty-seventh Day of October, 2009

David J. Kappos

David J. Kappos
*Director of the United States Patent and Trademark Office*